United States Patent [19]

Preissinger et al.

[11] Patent Number: 4,845,453

[45] Date of Patent: Jul. 4, 1989

[54] HIGH-VOLTAGE VOLTAGE TRANSFORMER WITH SHIELDS

[75] Inventors: Norbert Preissinger, Litzendorf; Hermann Eberlein, Modschiedel, both of Fed. Rep. of Germany

[73] Assignee: MWB Messwandler-Bau AG, Bamberg, Fed. Rep. of Germany

[21] Appl. No.: 268,340

[22] Filed: Nov. 7, 1988

[30] Foreign Application Priority Data

Nov. 9, 1987 [DE] Fed. Rep. of Germany ..... 3737989

[51] Int. Cl.[4] ..... H01F 15/04

[52] U.S. Cl. ..... 336/84 C

[58] Field of Search ..... 336/69, 70, 84 R, 84 C, 336/174

[56] References Cited

U.S. PATENT DOCUMENTS 2,170,048 8/1939 Dunning et al. ..... 336/84 C X 3,699,488 10/1972 Goodman et al. ..... 336/84 C

*Primary Examiner*—Thomas J. Kozma

*Attorney, Agent, or Firm*—Barnes & Thornburg

[57] ABSTRACT

A high-voltage voltage transformer with a core at high voltage which is surrounded coaxially by a high voltage winding provided with a slotted metal shield and with a low voltage winding also coaxially surrounding the same, as well as with a coaxial shielding electrode at ground potential and surrounding the high and low voltage winding is to be so constructed that coupling effects of high potentials for high frequency transient switching operations onto the secondary side, above all the secondary lead-out connecting lines cannot occur to any disturbing extent. This is achieved in that spaced at a slight distance up to a maximum of about 5 mm. from the metal shield a discharge electrode concentrically surrounding the same is provided insulated with respect to the metal shield. The discharge electrode is electrically conductively connected by way of one or several connecting lines of low inductance with the shielding electrode. The low voltage winding is provided with a further slotted metallic shielding which is also electrically conductively connected in a manner low in inductance with the shielding electrode (FIG. 2).

23 Claims, 3 Drawing Sheets

HIGH-VOLTAGE VOLTAGE TRANSFORMER WITH SHIELDS

BACKGROUND AND SUMMARY OF THE INVENTION

The present invention relates to a high-voltage voltage transformer, especially to a combined high-voltage current- and voltage-transformer of head-type construction with a core at high voltage that is surrounded coaxially by a high-voltage winding having a slotted metal shield and with a low-voltage winding also coaxially surrounding the high-voltage winding as well as with a coaxial shielding electrode at ground potential and surrounding the high- and low-voltage winding.

Such high-voltage voltage transformers are known as such. With combined current- and voltage transformers of head-type construction, it is customary to mount the active parts of the transformer consisting of a core and of a high- and low-voltage winding on an insulating column and to surround the same with a head housing. The insulating column is secured at a base part which carries the terminal box with the terminal panel for the lead-out connecting lines of the transformer. The secondary lead-out connecting lines from the head housing of the transformer to the terminal panel are therefore relatively long. This is true in particular for combined high-voltage current- and voltage-transformers of the type of construction according to the older, non-prepublished patent application P 36 08 390.9, which corresponds to U.S. Pat. No. 4,731,599, of the assignee of this application in which the voltage transformer is arranged above the current transformer.

As a result of the large distance conditioned by reason of the necessary fastening elements for the low-voltage winding between the metal shield of the high-voltage winding and of the low voltage winding, the capacity between the metallic shields of the two windings is relatively small.

It has now been discovered with such arrangements that during transient, especially high frequency occurrences, in particular triggered by switching operations, the metal shield of the high voltage winding of the voltage transformer which as such is at low voltage potential, can be raised to a high potential of some 10 kV up to 100 kV or more.

The consequence is that during the occurence of high potentials by reason of high frequency transient surge or over-voltages at the metal shield of the high-voltage winding, these high frequency voltages may be coupled into the low voltage winding. This may even lead to the destruction of such high-voltage voltage transformers if the insulation between the metallic shielding and the low-voltage winding is destroyed.

Accordingly, it is the object of the present invention to so improve a high-voltage voltage transformer, especially a combined high-voltage current- and voltage-transformer of head-type construction of the aforementioned type, that coupling effects of high potentials, especially triggered by high frequency transient switching operations, onto the secondary side of the transformer, especially onto the secondary connecting terminals can no longer occur to any troubling extent.

The underlying problems are solved according to the present invention in that the metal shield is connected with the connecting terminal for the high-voltage winding, a discharge electrode concentrically surrounding the metal shield is provided insulated with respect to the metal shield at a small distance of up to 5 mm. from the metal shield, the discharge electrode is electrically conductively connected low in inductance with shield electrode by way of one or several connecting lines.

The present invention assures that a very large capacity is formed between the metal shield of the high voltage winding and the discharge electrode of the voltage transformer. The discharge electrode is electrically connected with the outer shielding electrode along the shortest path and therewith extraordinarily low in inductance. A rise of the potential of the metal shield of the high voltage winding to non-permissively high values is thereby reliably prevented and a coupling of non-permissively high transient over-voltages into the low voltage winding is prevented.

BRIEF DESCRIPTION OF THE DRAWINGS

These and other objects, features and advantages of the present invention will become more apparent from the following description when taken in connection with the accompanying drawing which shows, for purposes of illustration only, several embodiments in accordance with the present invention, and wherein.

DETAILED DESCRIPTION OF THE DRAWINGS

Figure 1:
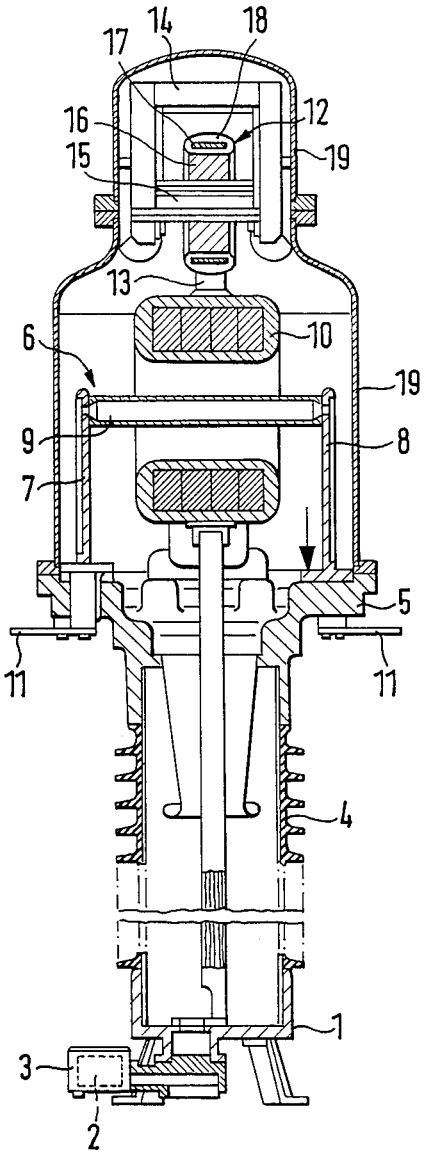
FIG. 1 is a somewhat schematic cross-sectional view of a combined high-voltage current- and voltage transformer of head-type construction in accordance with the present invention.

Referring now to the drawing wherein like reference numerals are used to designate corresponding parts in the various views, a combined high voltage current- and voltage-transformer is illustrated in FIG. 1. It consists of a base part 1 with a terminal box 3 containing a terminal panel 2. A support insulator 4 is sealingly and securely arranged on the base part 1, which carries at the top a metallic closure plate 5. A U-shaped primary conductor 6 with the legs 7 and 8 and the base 9 is secured on the plate 5, whereby the one leg 8 is electrically conductively connected with the closure plate 5 and the other leg 7 is electrically insulatingly lead out and adapted to be contacted from the outside.

The base 9 of the primary conductor 6 is concentrically surrounded by a secondary winding 10 having several cores. The primary conductor 6 and the secondary winding 10 form a high voltage current transformer whose secondary lead-out connecting lines are extended to the terminal panel 2. The connections 11 of the legs 7 and 8 and therewith the closure plate 5 are at high voltage potential.

A high-voltage voltage transformer 12 is arranged above the high-voltage current transformer 6, 10. The high-voltage voltage transformer 12 is electrically connected with the high-voltage current transfomer 6, 10, for example, by means of a connecting member 13 whereby the lead-out connecting lines of the voltage transformer 12 are arranged in the connecting member 13 and are then extended to the terminal panel 2, like the secondary lead-out connecting lines of the current transformer 6, 10.

The voltage transformer 12 consists in a known manner of an iron core 15 of magnetizable material. The high voltage winding 16 is applied about the one leg thereof as cylinder-, banked- or trapezoidal winding. The same is surrounded concentrically by a low-voltage winding 17. These active parts of the entire voltage transformer 12 are surrounded concentrically by a ring-shaped, respectively, cylindrical shielding electrode 18 disposed at ground potential.

A pot-shaped single- or multi-partite housing 19 is sealingly and securely attached on the closure plate 5 which surrounds in common both transformers 6, 10 and 12 and is at high voltage potential.

Figure 2:
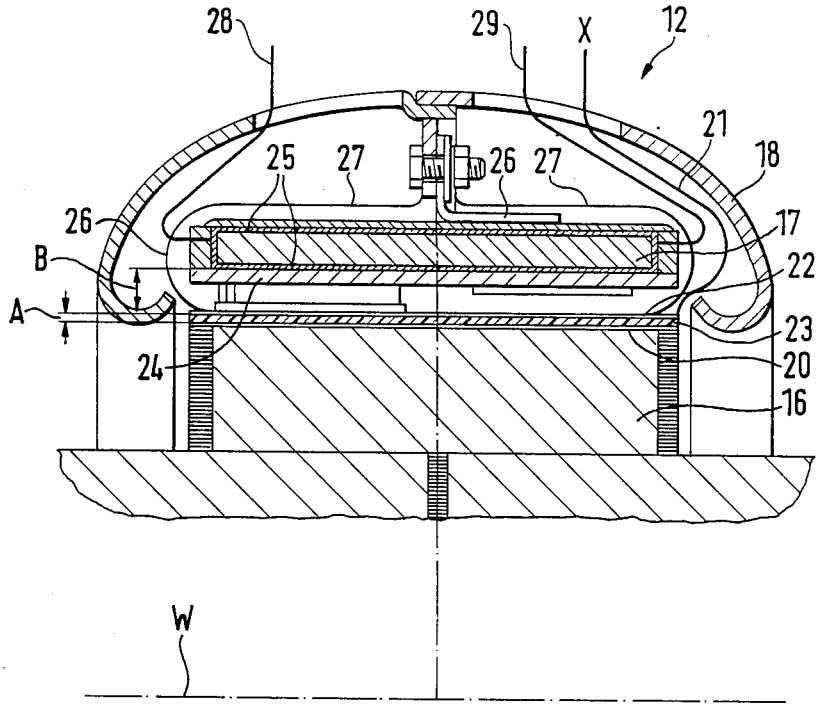
FIG. 2 is a somewhat schematic partial cross-sectional view of a high-voltage voltage transformer, especially for the use of a combined transformer according to FIG. 1.

A section of the voltage transformer of a combined high-voltage current- and voltage-transformer of head-type construction according to FIG. 1 is illustrated in FIG. 2. Of course, this voltage transformer can also find application without being combined with a current transformer. The last winding or winding layers of the two-step high-voltage winding 16 surrounding the iron core is provided with a slotted metal shield 20 extending over the winding length thereof. The metal shield 20 consists of a layer of electrically good conducting material, for example, copper, silver or zinc, or of a metal layer in the form of a metal film or of a metal cylinder. The metal shield 20 is slotted in a known manner in the direction of the longitudinal axis W of the winding in order to prevent the occurence of short-circuit currents. An outlet line 21 which is electrically connected with the metal shield 20, is extended to the connecting terminal X for the high-voltage winding 16 in the terminal panel 2.

At a small distance A from the metal shield 20 a discharge electrode 22 concentrically surrounding the same is provided which forms a large capacity with the metal shield 20. The intermediate space present as a result of the distance A is partly or completely filled with insulating bands or insulating films whereby the same are impregnated with the insulating gas or with a liquid insulating medium of the existing gas- or oil-insulated combined high-voltage current- and voltage-transformer. The provision of only a few insulating layers, for example, from four to six insulating layers with an insulating band- or insulating film-thickness of 40 to 60μ suffices which produces an overall distance A of 160 to 360μ. However, also several insulating layers can be provided up to a maximum distance A of about 5 mm.

In order that no short-circuit current is induced also in the discharge electrode 22, the same is also provided with at least one slot extending in the direction of the winding axis W. The discharge electrode 22 consists of an electrically conductive layer, especially metal layer or of a metallic cylinder or of a metal film or sections thereof. With the use of metallic cylinder- or metal film-electrodes, the same can be adhesively bonded and/or bandaged-in, for example, by means of an insulating bandage winding.

The coaxial low voltage winding 17 is arranged above the discharge electrode 22 at a relatively large distance B which is determined above all by necessary fastening and support elements 24. The low voltage winding 17 is provided with a grounded metallic shielding 25 which preferably surrounds the low voltage winding 17 on all sides; however, its cylindrical parts are also slotted in the direction of the longitudinal axis W of the low voltage winding 17 and in the circumferential direction in order to prevent short-circuit currents. The shielding 25 of the low voltage winding 17 is electrically conductively connected by a connection low in inductance with the shielding electrode 18 placed at ground potential by way of one, preferably several, connecting lugs 26 distributed over the circumference.

The discharge electrode 22 is also connected with the shielding electrode 18 by way of at least one, however, preferably by way of a large number of short and as wide as possible connecting lines 27 distributed over the circumference. The connection is to be as low in inductance as possible, i.e., must be constructed as short as possible.

The secondary lead-out connecting lines 28, 29 of the low voltage winding 17, like the lead-out connecting line 21 for the metal shield 20, are extended to the terminal panel 2. This can take place in common under maintenance of an insulating level of 3 kV inside of the connecting-line pipe. The danger of breakdowns at transient high frequency occurences as a result of a coupling effect to high potentials onto the connection terminals in the terminal box 3 is effectively precluded by the measures according to the invention.

Figure 3:
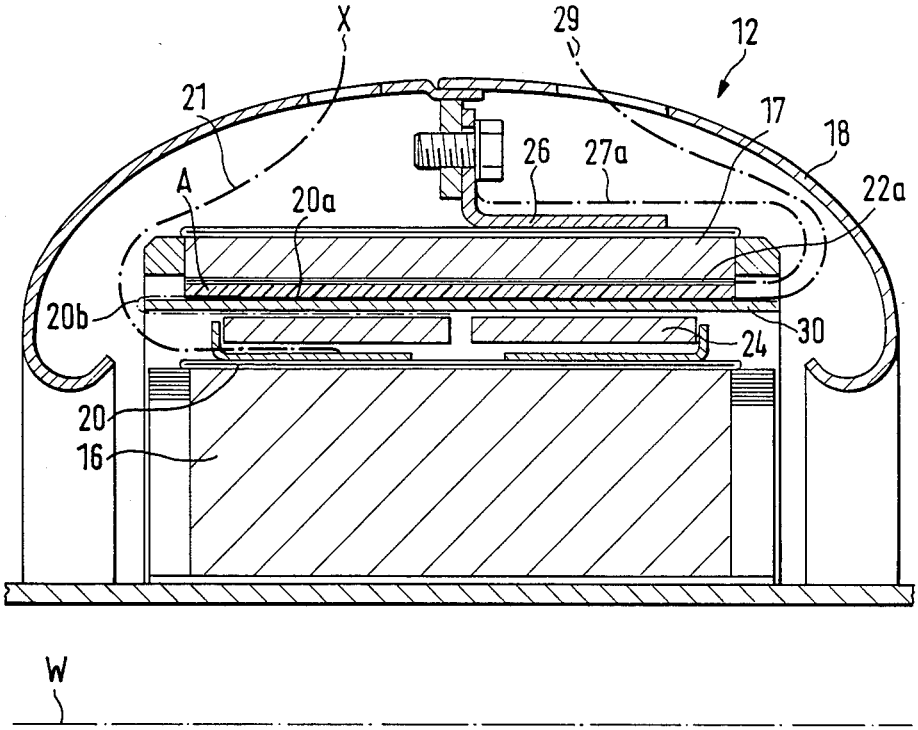
FIG. 3 is a somewhat schematic, partial cross-sectional view of a modification of the high-voltage voltage transformer according to FIG. 2.

In the embodiment according to FIG. 3 which illustrates a modification of the high-voltage voltage transformer according to FIG. 2, the same parts are designated with the same reference numerals as in FIG. 2.

Figure 4:
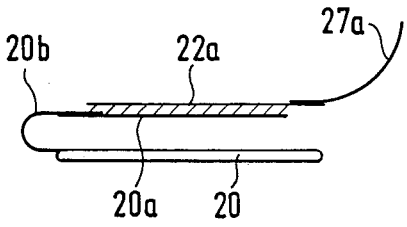
FIGS. 4 and 5 are schematic views of the shields and discharge electrodes used in the embodiment according to FIG. 3.

In modification of the high-voltage voltage transformer according to FIG. 2, the metal shield 20 of the high-voltage winding 16 is electrically conductively in contact in this embodiment by way of electrically conducting connecting elements **20*b* distributed over the circumference of the high-voltage winding 16 and the metal blocks 24 with at least one further metallic layer 20*a* on the support body 30 of the low-voltage winding 17 and is connected by means of the lead-out connecting line 21 with the connecting terminal X for the high-voltage winding 16. Details therefor can be seen in particular from FIGS. 4 and 5**.

Spaced at a slight distance A up to maximum 5 mm. from at least one of the further metallic layers **20*a* on the support body 30 of the low-voltage winding 17, at least one discharge electrode 22*a* concentrically surrounding this further metallic layer 20*a* is electrically insulatingly provided. The electric insulation between the metallic layers 20*a* and the discharge electrodes 22*a* corresponds preferably to the embodiment, as has been described more fully in FIG. 2. Also in the embodiment according to FIG. 3 the discharge electrode, respectively, discharge electrodes 22*a* are electrically conductively connected with the shielding electrode 18 by way of one or several connecting lines 27*a*** along the shortest path, i.e., by a connection low in inductance.

Figure 5:
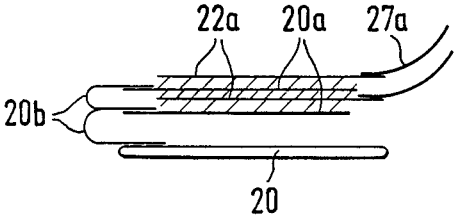

The use of several metallic layers **20*a* and correspondingly several discharge electrodes 22*a* according to FIG. 5** offers the advantage of a larger capacity between these layers, respectively, electrodes.

While we have shown and described several embodiments in accordance with the present invention, it is understood that the same is not limited thereto but is susceptible numerous changes and modifications as known to those skilled in the art, and we therefore do not wish to be limited to the details shown and described herein, but intend to cover all such changes and modifications as are encompassed by the scope of the appended claims.

We claim:

1. A high-voltage, voltage transformer, comprising core means disposed at high voltage, high-voltage winding means coaxially surrounding the core means and provided with a slotted metal shield means, low voltage winding means coaxially surrounding the high voltage winding means, substantially coaxial shielding electrode means surrounding the high voltage and low voltage winding means and disposed at ground potential, a connecting terminal for the high voltage winding means, the slotted metal shield means being connected with the connecting terminal for the high-voltage winding means by a lead-out connecting line, a discharge electrode means spaced at a slight distance of up to a maximum of about 5 mm. from the slotted metal shield means and substantially concentrically surrounding and insulated from the slotted metal shield means, the discharge electrode means being electrically conductively connected with the coaxial shielding electrode means by way of at least one connecting line means in a manner to provide a low inductance.

2. A high-voltage, voltage transformer according to claim 1, wherein the low voltage winding means is provided with a further slotted metallic shield means which is also electrically conductively connected with the discharge electrode means to provide a low inductance.

3. A high-voltage, voltage transformer according to claim 2, wherein said distance between the slotted metal shield means and the discharge electrode means is formed at least partially by several layers of insulating material.

4. A high-voltage, voltage transformer according to claim 3, wherein the distance between the metal shield means and the discharge electrode means is completely filled by said insulating material.

5. A high-voltage, voltage transformer according to claim 3, wherein the discharge electrode means essentially consists of a conductive layer applied on an insulating member and split in the direction of the winding axis.

6. A high-voltage, voltage transformer according to claim 3, wherein the discharge electrode means essentially consists of a metallic cylinder adapted to be slipped over the insulating material and slotted in the direction of the winding axis.

7. A high-voltage, voltage transformer according to claim 6, wherein the metal cylinder is secured on the insulating material of the slotted metal shield means by an adhesive bond.

8. A high-voltage, voltage transformer according to claim 3, wherein the lead-out connecting line for the connecting terminal of the high voltage winding means is extended to a common terminal panel insulated with respect to the housing means and lead-out connecting lines of the low voltage winding means.

9. A high-voltage, voltage transformer according to claim 8, wherein the transformer is under the pressure of insulating gas.

10. A high-voltage, voltage transformer, comprising core means disposed at high voltage, high-voltage winding means provided with a slotted metal shield means and coaxially surrounding the core means, low-voltage winding means also coaxially surrounding the high-voltage winding means, coaxial shielding electrode means disposed at ground potential and surrounding the high- and low-voltage winding means, the slotted metal shield means of the high-voltage winding means being electrically conductively in contact with at least one further metallic layer on a support means for the low-voltage winding means, the slotted metal shield means being also operatively connected by a lead-out connecting line with the connecting terminal for the high voltage winding means, at least one discharge electrode means substantially concentrically surrounding and electrically insulated from the low-voltage winding means, the at least one discharge electrode means being spaced at a slight distance up to a maximum of about 5 mm. from at least one of the further metallic layers on the low voltage winding means, and the discharge electrode means being electrically conductively connected with the coaxial shielding electrode means by way of at least one connecting line along a short path to provide a low inductance.

11. A high-voltage, voltage transformer according to claim 1, wherein said distance between the metal slotted shield means and the discharge electrode means is formed at least partially by several layers of insulating material.

12. A high-voltage, voltage transformer according to claim 11, wherein the distance between the metal shield means and the discharge electrode means is completely filled by said insulating material.

13. A high-voltage, voltage transformer according to claim 1, wherein the discharge electrode means essentially consists of a conductive layer applied on an insulating member and split in the direction of the winding axis.

14. A high-voltage, voltage transformer according to claim 1, wherein the discharge electrode means essentially consists of a metallic cylinder adapted to be slipped over the insulating material and slotted in the direction of the winding axis.

15. A high-voltage, voltage transformer according to claim 14, wherein the metal cylinder is secured on the insulating material of the slotted metal shielding means by an adhesive bond.

16. A high-voltage, voltage transformer according to claim 1, wherein the lead-out connecting line for the connecting terminal of the high voltage winding means is extended to a common terminal panel insulated with respect to the housing means and lead-out connecting lines of the low voltage winding means.

17. A high-voltage, voltage transformer according to claim 1, wherein the transformer is under the pressure of insulating gas.

18. A high-voltage, voltage transformer according to claim 3, wherein said layers of insulating material are band-shaped.

19. A high-voltage, voltage transformer according to claim 3, wherein said layers of insulating material are film-shaped.

20. A high-voltage, voltage transformer according to claim 6, wherein the metal cylinder is secured on the insulating material of the slotted metal shield means by an external insulating bandage winding.

21. A high-voltage, voltage transformer according to claim 11 wherein said layers of insulating material are band-shaped.

22. A high voltage, voltage transformer according to claim 11, wherein said layers of insulating material are film-shaped.

23. A higher voltage, voltage transformer according to claim 14, wherein the metal cylinder is secured on the insulating material of the slotted metal shield means by an external insulating bandage winding.

* * * * *